US010801210B2

(12) United States Patent
Yamaji et al.

(10) Patent No.: US 10,801,210 B2
(45) Date of Patent: Oct. 13, 2020

(54) SUNSHADE

(71) Applicants: Fractal Japan Co., Ltd., Tokyo (JP); Natural Power Initiative Co., Ltd., Tokyo (JP)

(72) Inventors: Katsuhiko Yamaji, Tokyo (JP); Kenji Morisaki, Tokyo (JP)

(73) Assignees: FRACTAL JAPAN CO., LTD., Tokyo (JP); NATURAL POWER INITIATIVE CO., LTD., Tokyo (JP)

( * ) Notice: Subject to any disclaimer, the term of this patent is extended or adjusted under 35 U.S.C. 154(b) by 0 days.

(21) Appl. No.: 16/349,420

(22) PCT Filed: Nov. 13, 2017

(86) PCT No.: PCT/JP2017/040709
§ 371 (c)(1),
(2) Date: May 13, 2019

(87) PCT Pub. No.: WO2018/092706
PCT Pub. Date: May 24, 2018

(65) Prior Publication Data

US 2019/0338527 A1 Nov. 7, 2019

(30) Foreign Application Priority Data

Nov. 16, 2016 (JP) ..... 2016-223163

(51) Int. Cl.
*E04F 10/08* (2006.01)
*E04F 10/00* (2006.01)
*E04H 1/12* (2006.01)

(52) U.S. Cl.
CPC ..... *E04F 10/08* (2013.01); *E04F 10/005* (2013.01); *E04H 1/12* (2013.01)

(58) Field of Classification Search
CPC ..... E04F 10/08; E04F 10/005; E04F 10/00; E04H 1/12
See application file for complete search history.

(56) References Cited

U.S. PATENT DOCUMENTS 3,197,820 A * 8/1965 Clarie, Sr. ..... E06B 9/01 52/660
D605,813 S * 12/2009 Bear ..... D26/121
(Continued)

FOREIGN PATENT DOCUMENTS

JP 2012255291 A * 12/2012
JP 5315514 B2 10/2013
(Continued)

OTHER PUBLICATIONS

International Search Report dated Dec. 26, 2017, issued in counterpart application No. PCT/JP2017/040709 (2 pages).

*Primary Examiner* — Jessie T Fonseca
(74) *Attorney, Agent, or Firm* — Westerman, Hattori, Daniels & Adrian, LLP

(57) ABSTRACT

To realize a technique that allows for uniformly exhibiting performance without causing partial degradation of performance even when forming a large-scale sunshade with a large area. A sunshade 76 including a plurality of sunshade units (normal units 66, inverted units 75) having assembled thereto, in alignment in a certain direction, a plurality of sunshade members 50 having a plurality of light-shielding surfaces and a plurality of through-holes three-dimensionally arranged therein, and being structured so that, when observed from a predetermined maximum light-shielding angle, the transmitted light beams are seen to be substantially shielded by respective light-shielding surfaces provided therebehind, with some of the sunshade units being provided at higher positions than other sunshade units in the vertical direction.

2 Claims, 17 Drawing Sheets

(56) References Cited

U.S. PATENT DOCUMENTS

| | | | | | |
|---|---|---|---|---|---|
| D622,896 | S * | 8/2010 | Bear | ..... | D26/121 |
| 8,522,489 | B2 * | 9/2013 | Bear | ..... | E04C 2/08<br>52/173.1 |

FOREIGN PATENT DOCUMENTS

| | | | | | |
|---|---|---|---|---|---|
| JP | 2014034857 | A * | 2/2014 | | |
| JP | 5763977 | B2 | 8/2015 | | |
| JP | 2015-172304 | A | 10/2015 | | |
| JP | 2015172304 | A * | 10/2015 | | |
| JP | 2016-17299 | A | 2/2016 | | |
| WO | WO-2010147128 | A1 * | 12/2010 | ..... | E04F 10/08 |

* cited by examiner

[FIG.1]
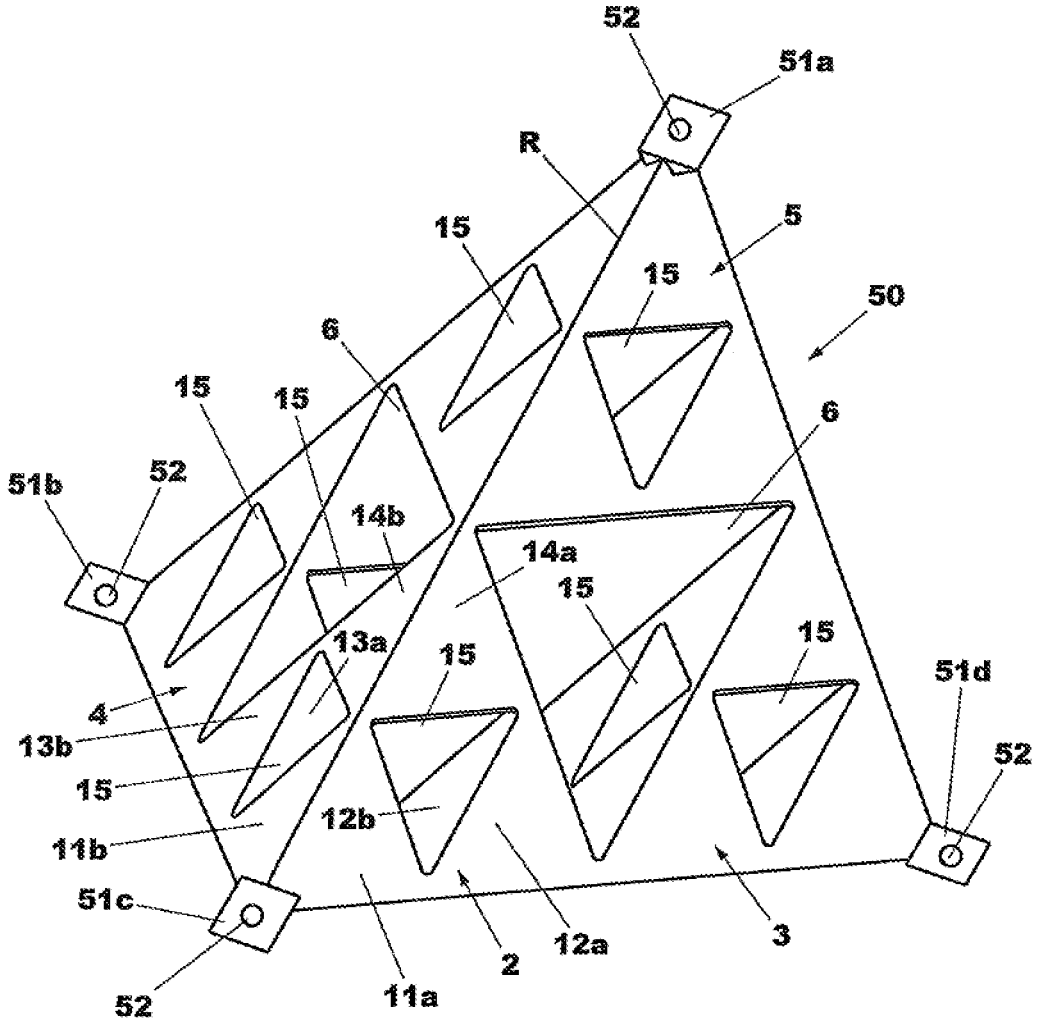

[FIG.2]
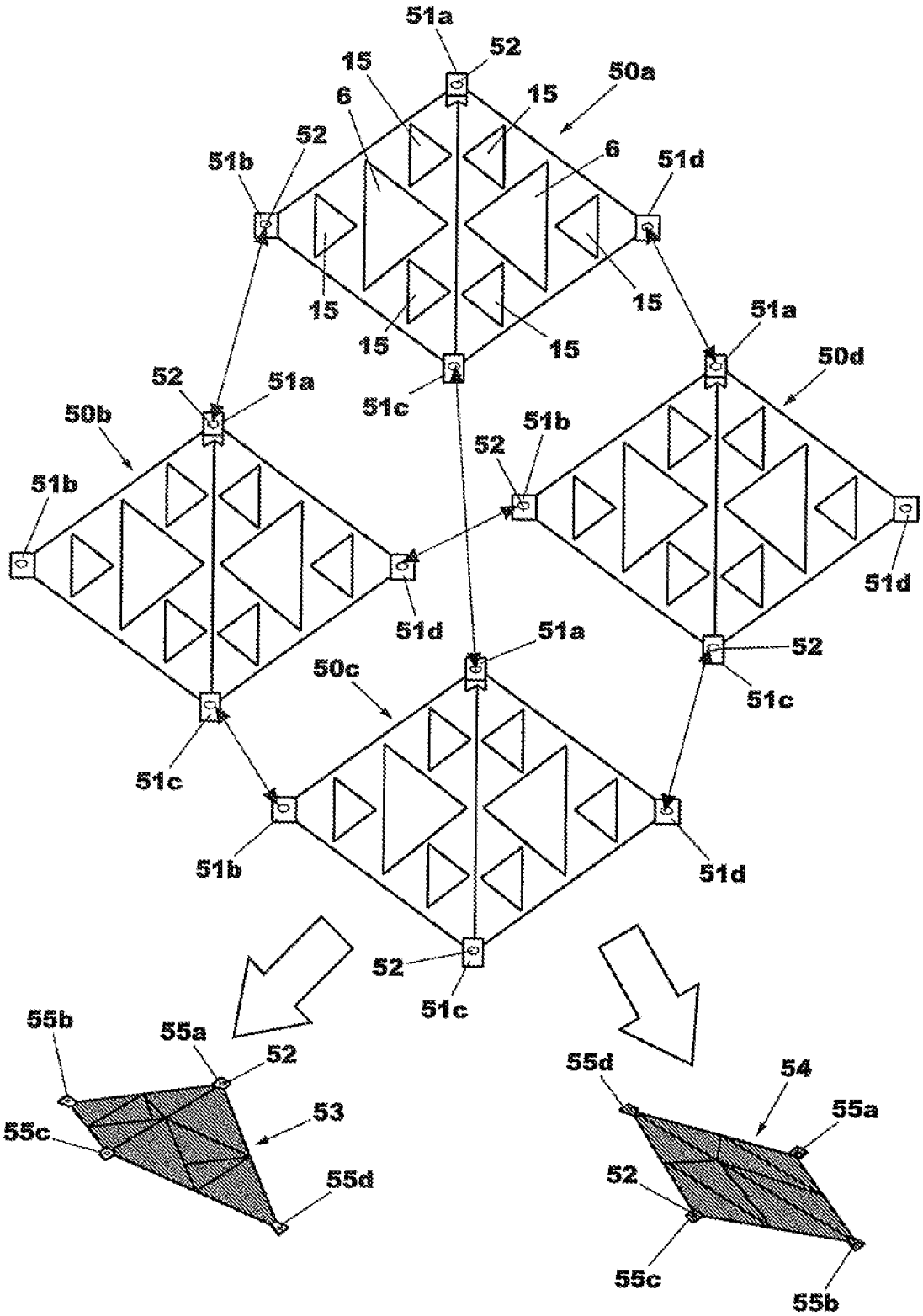

[FIG.3]
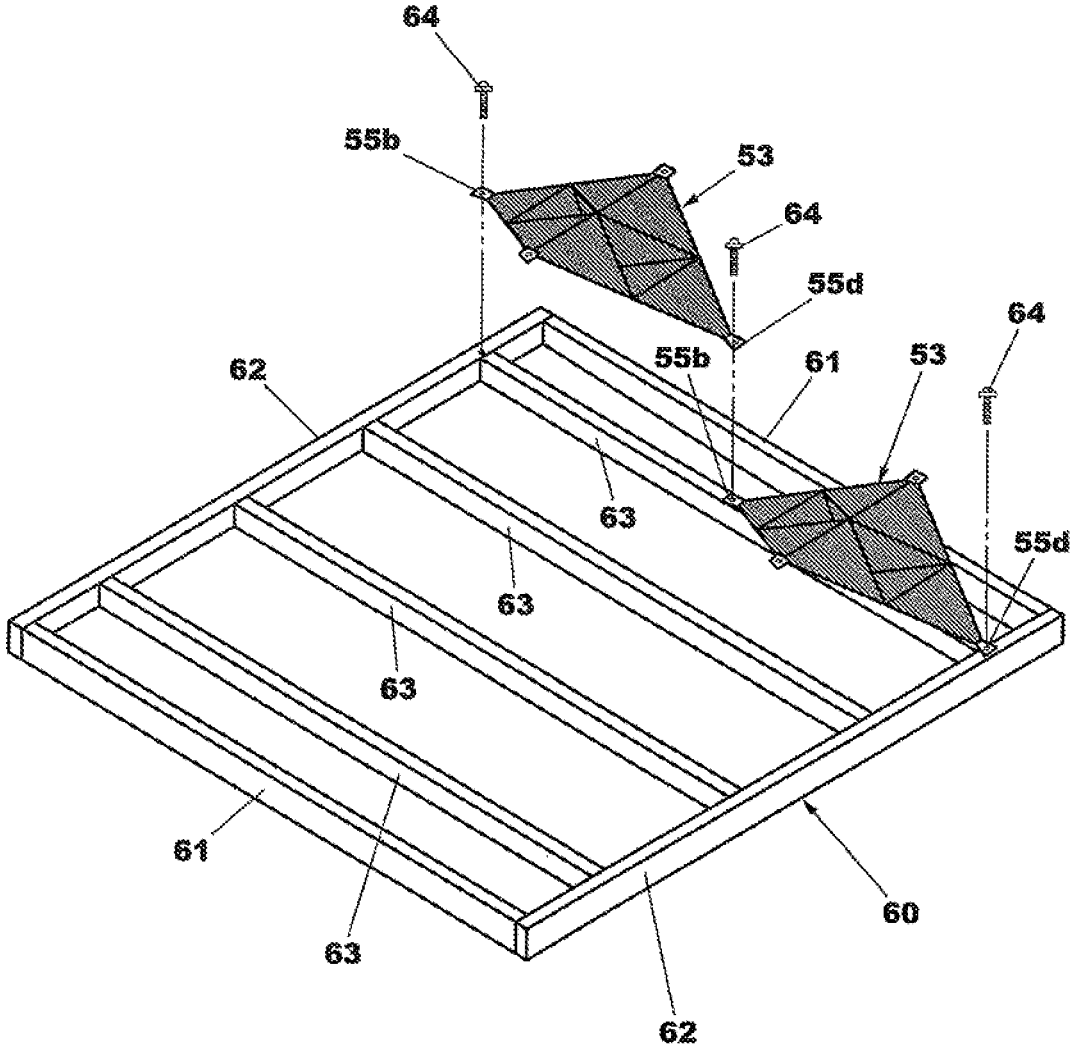

[FIG.4]
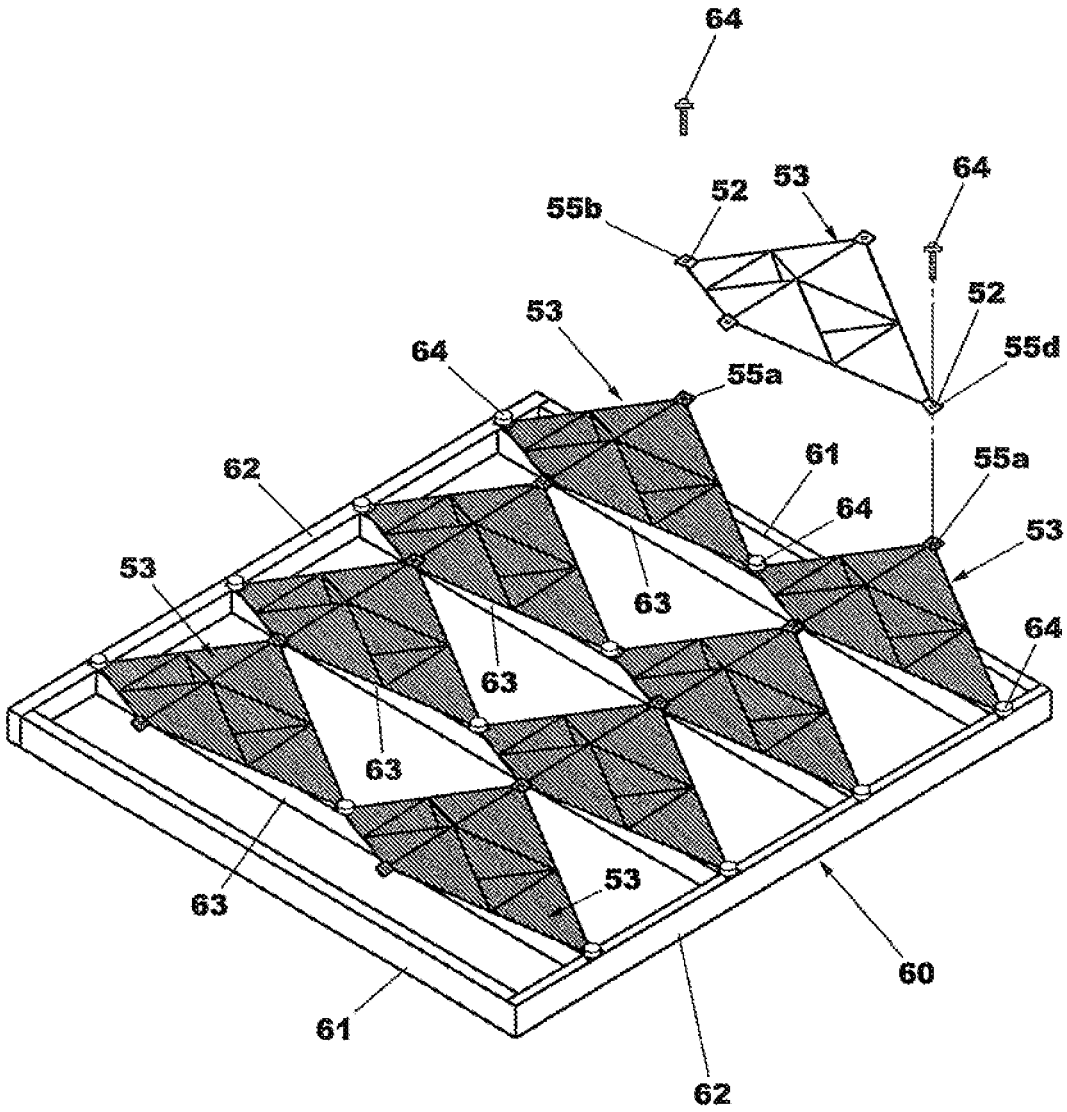

[FIG.5]
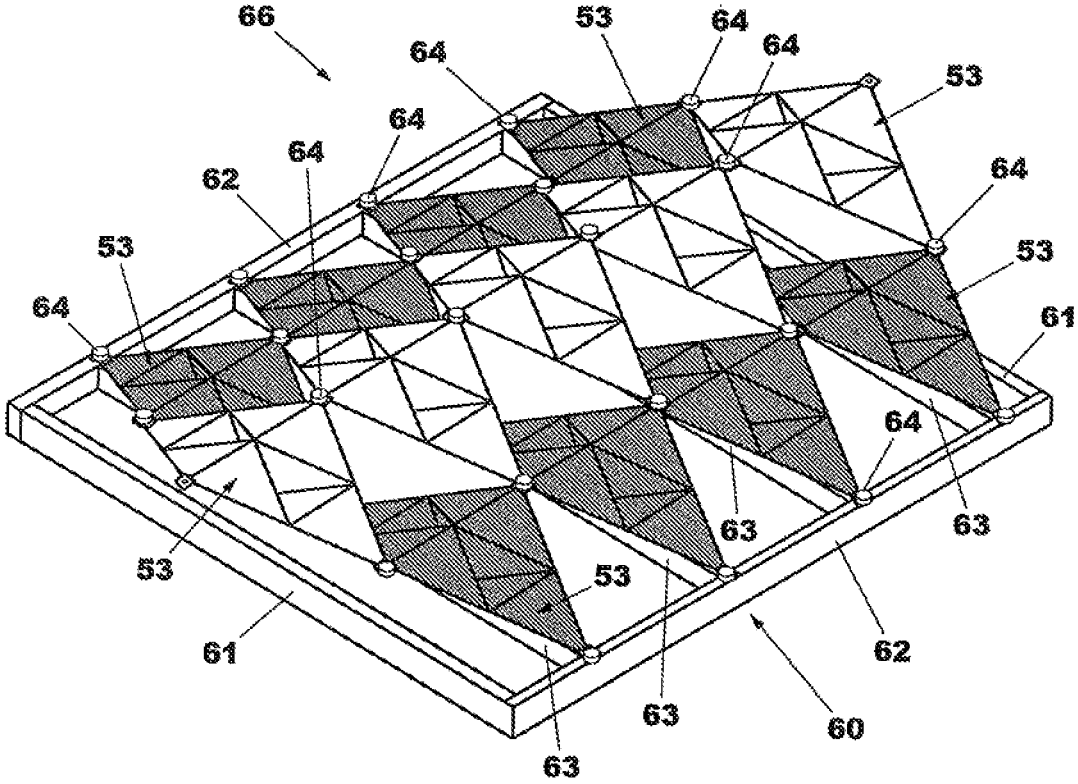

[FIG.6]
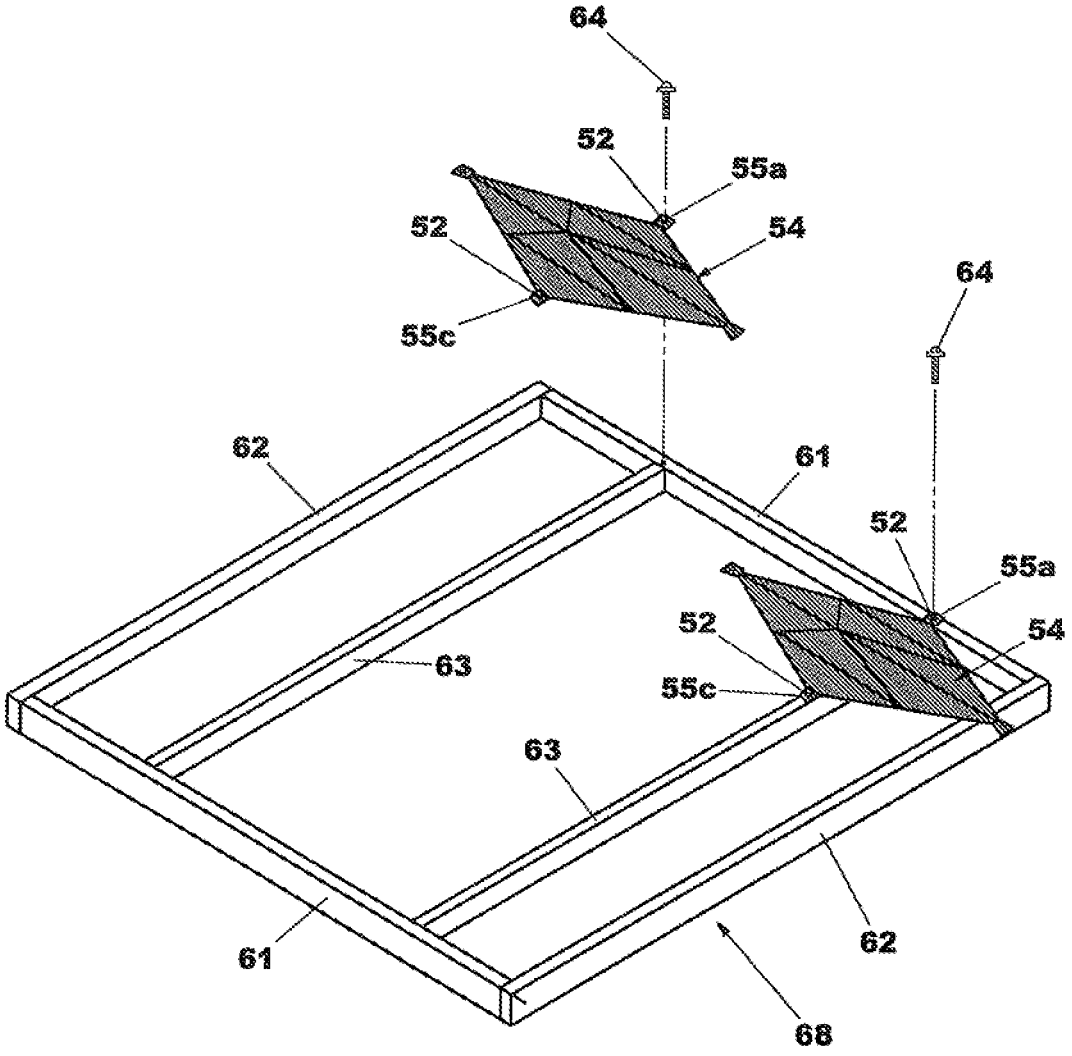

[FIG.7]
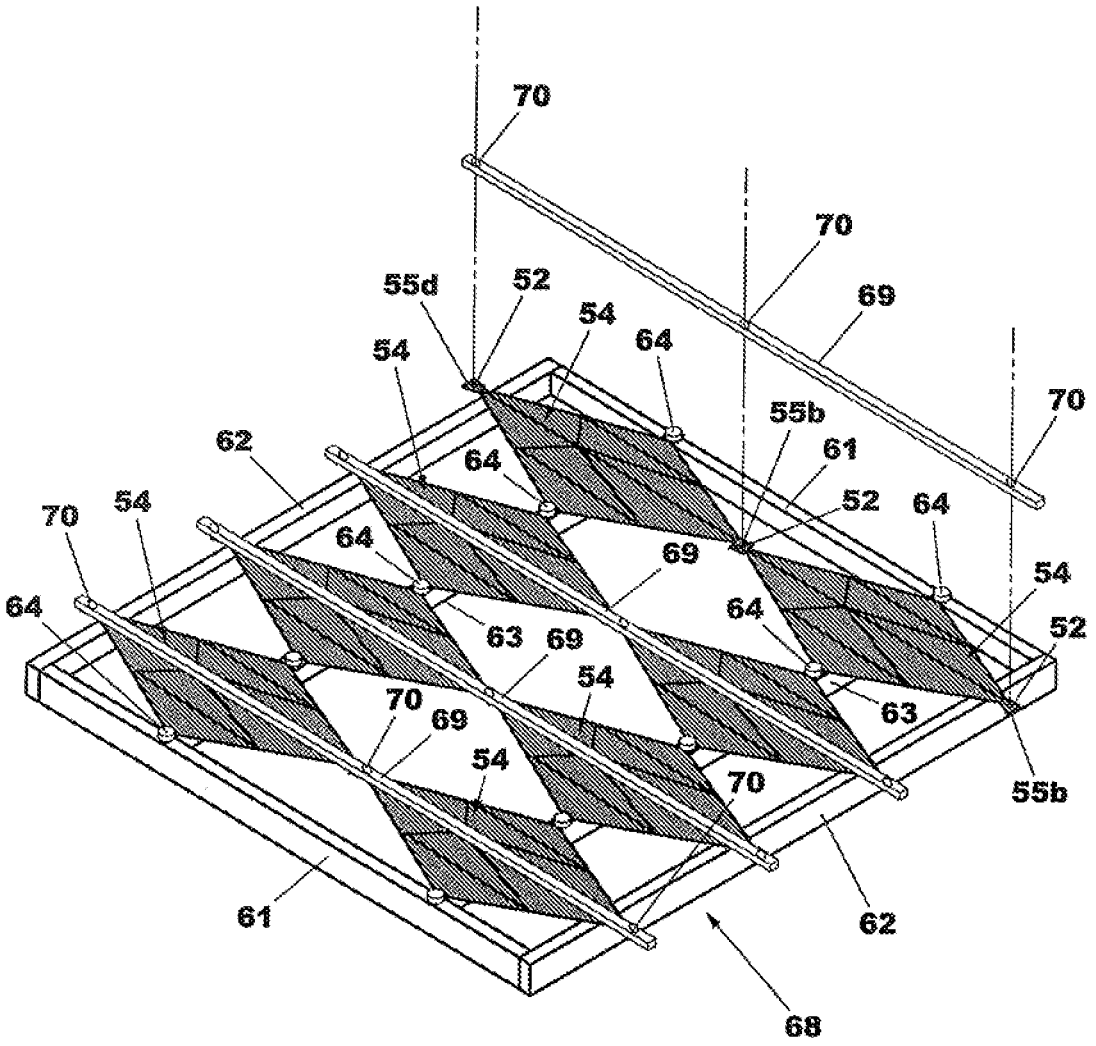

[FIG.8]
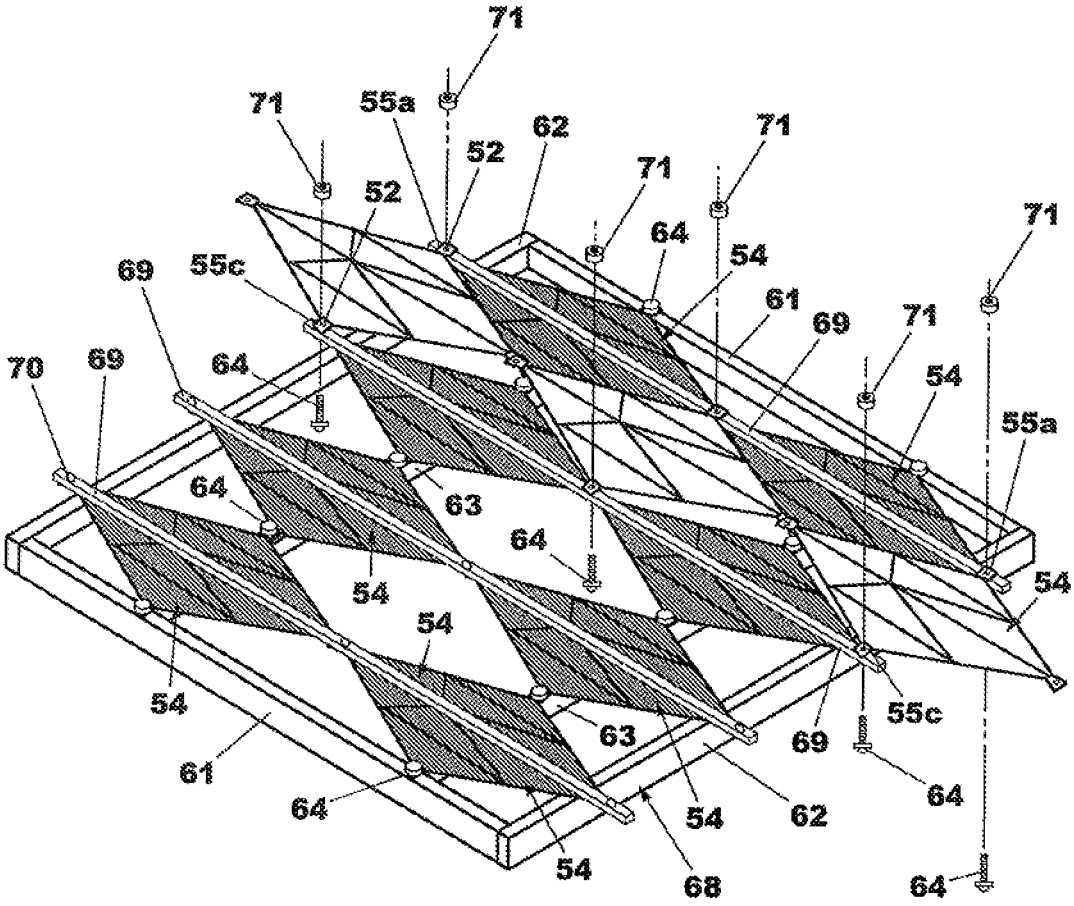

[FIG.9]
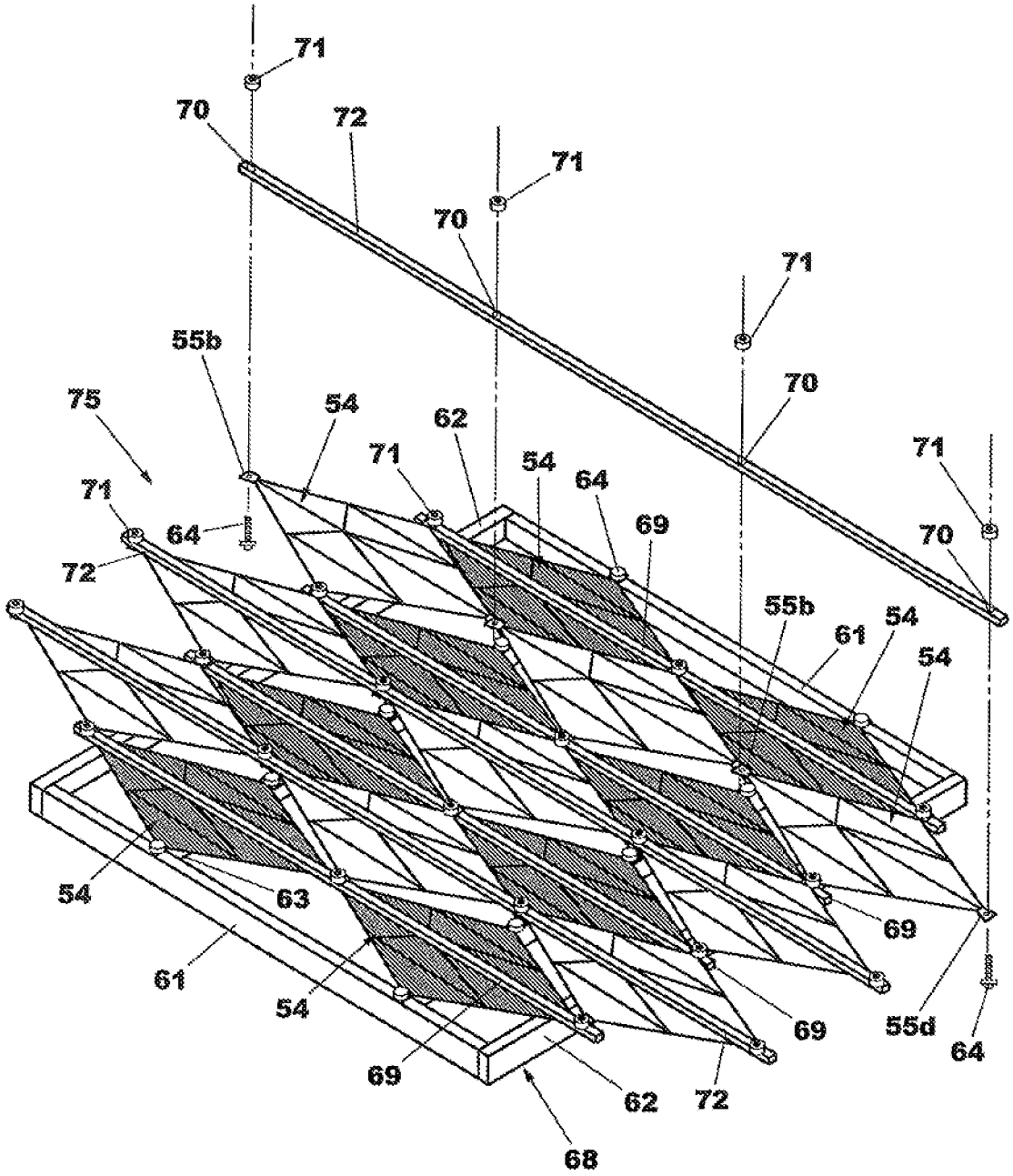

[FIG.10]
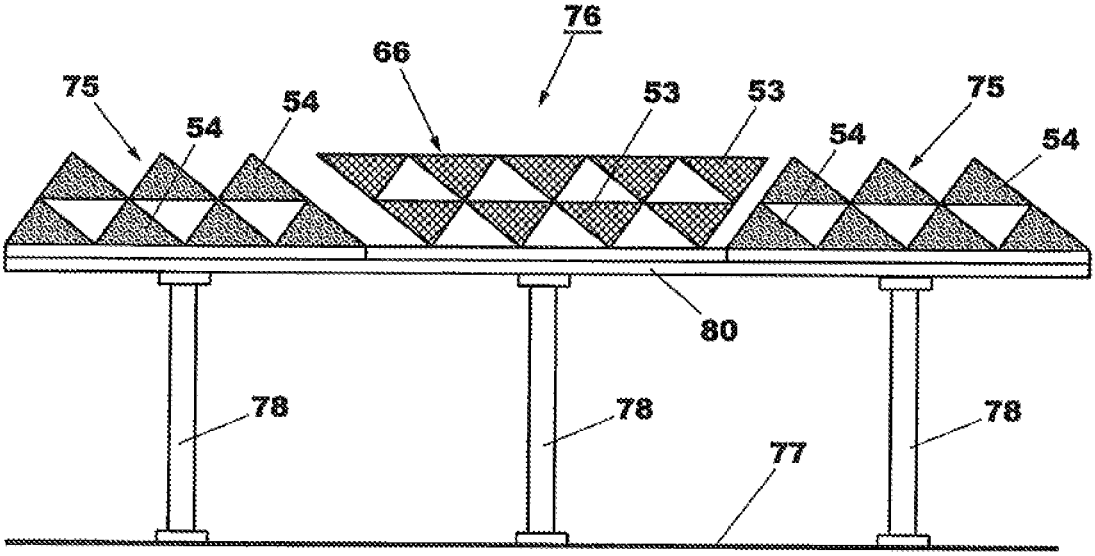

[FIG.11]
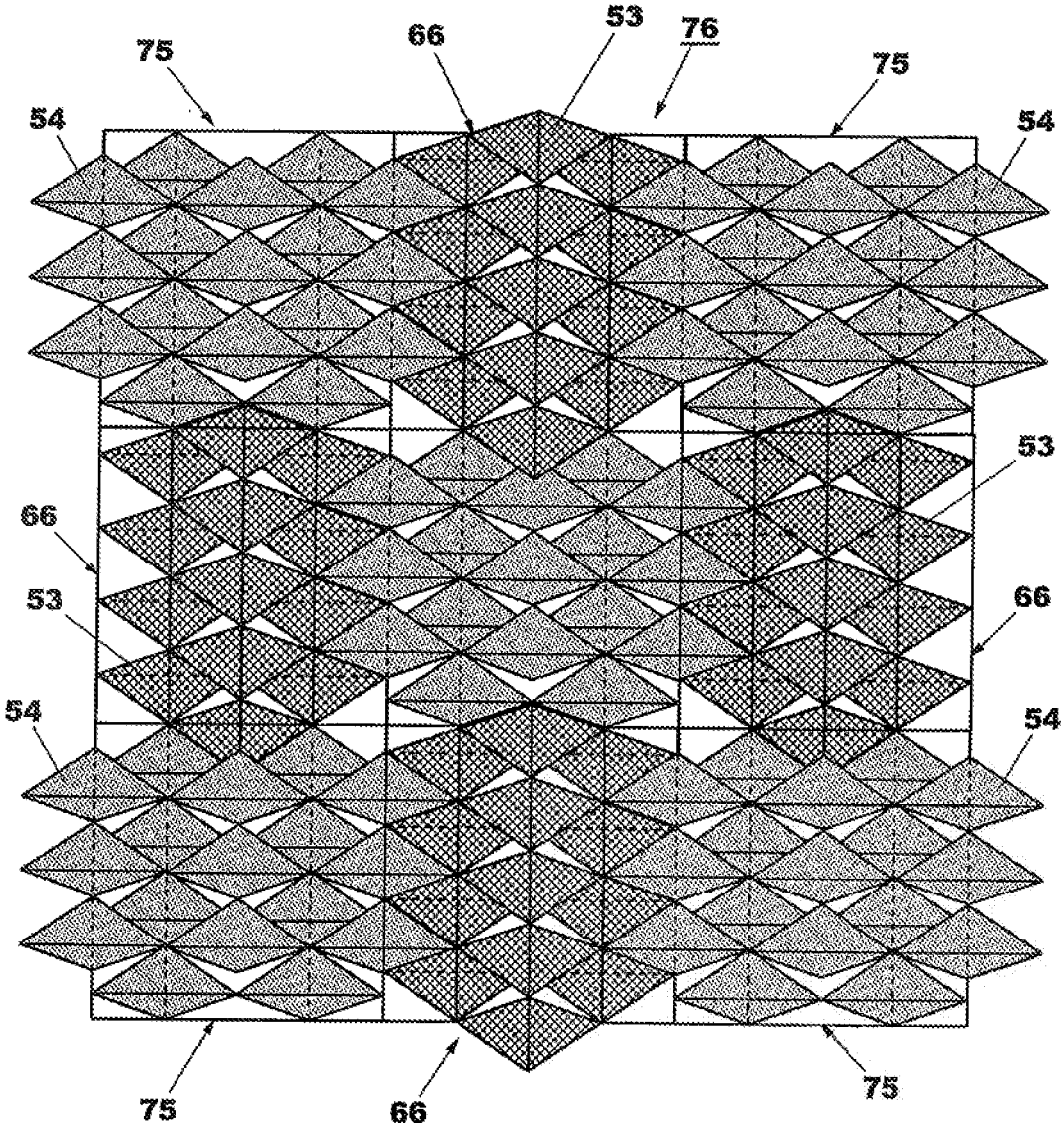

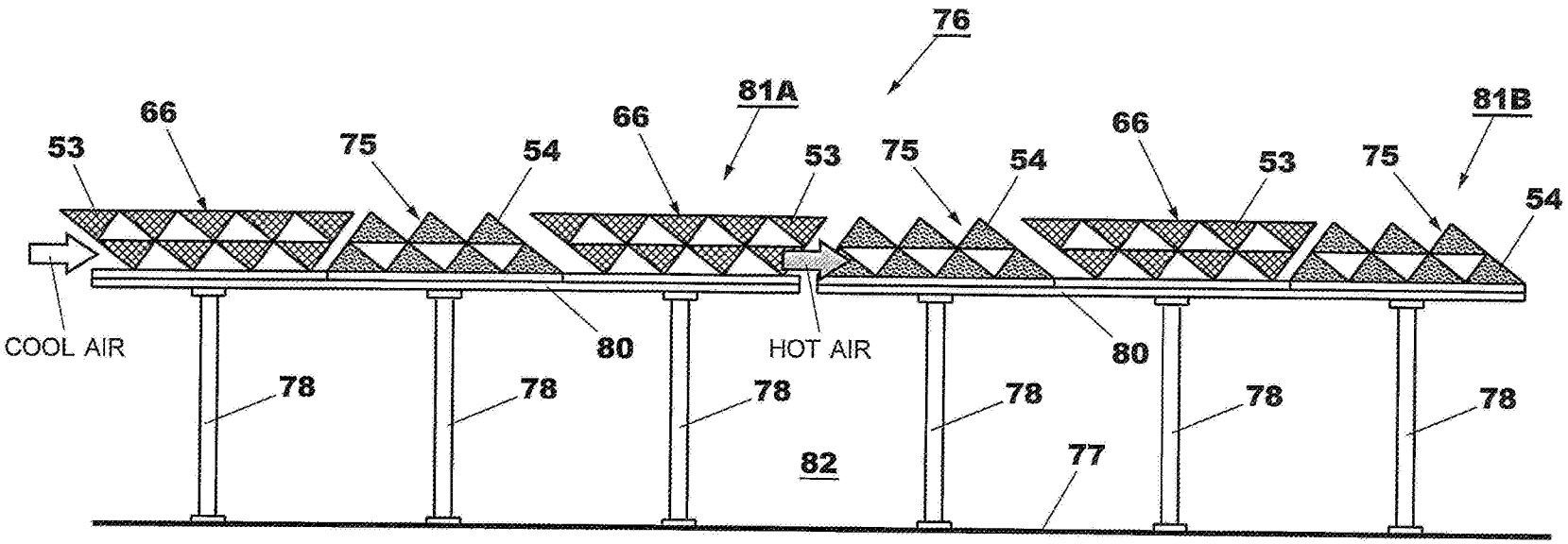
[FIG.12]

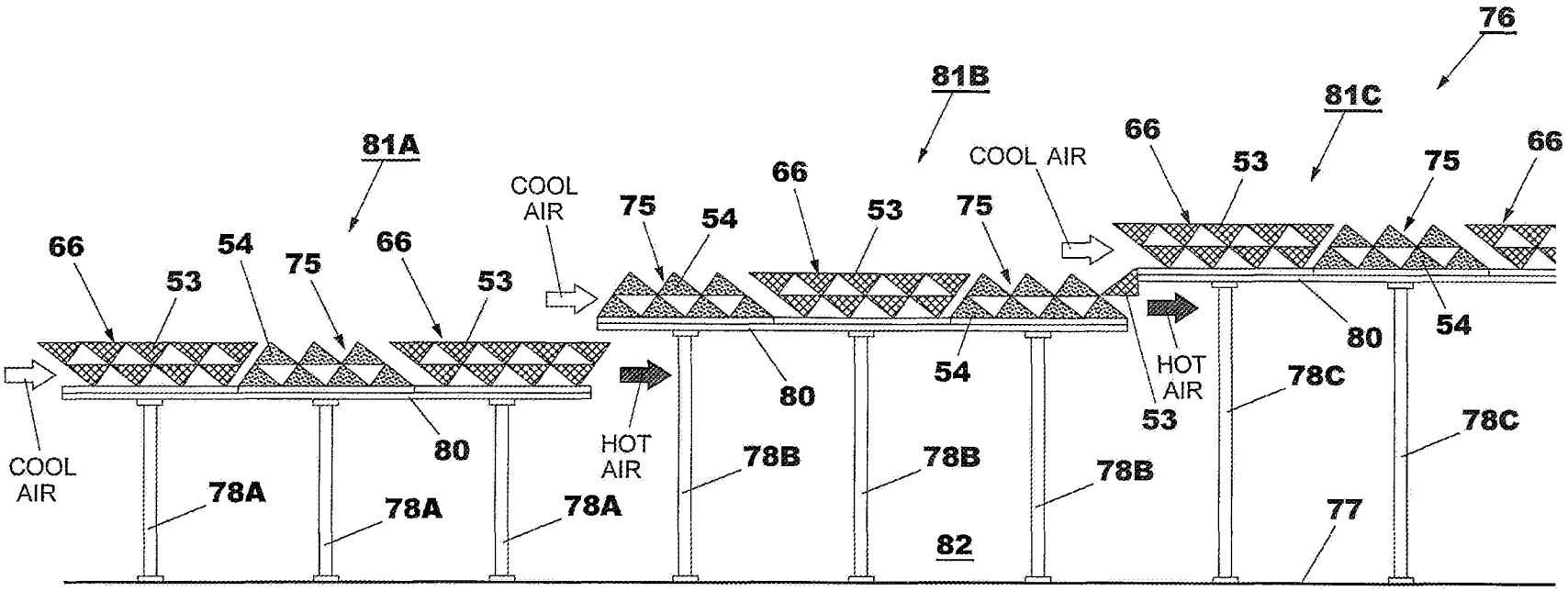
[FIG.13]

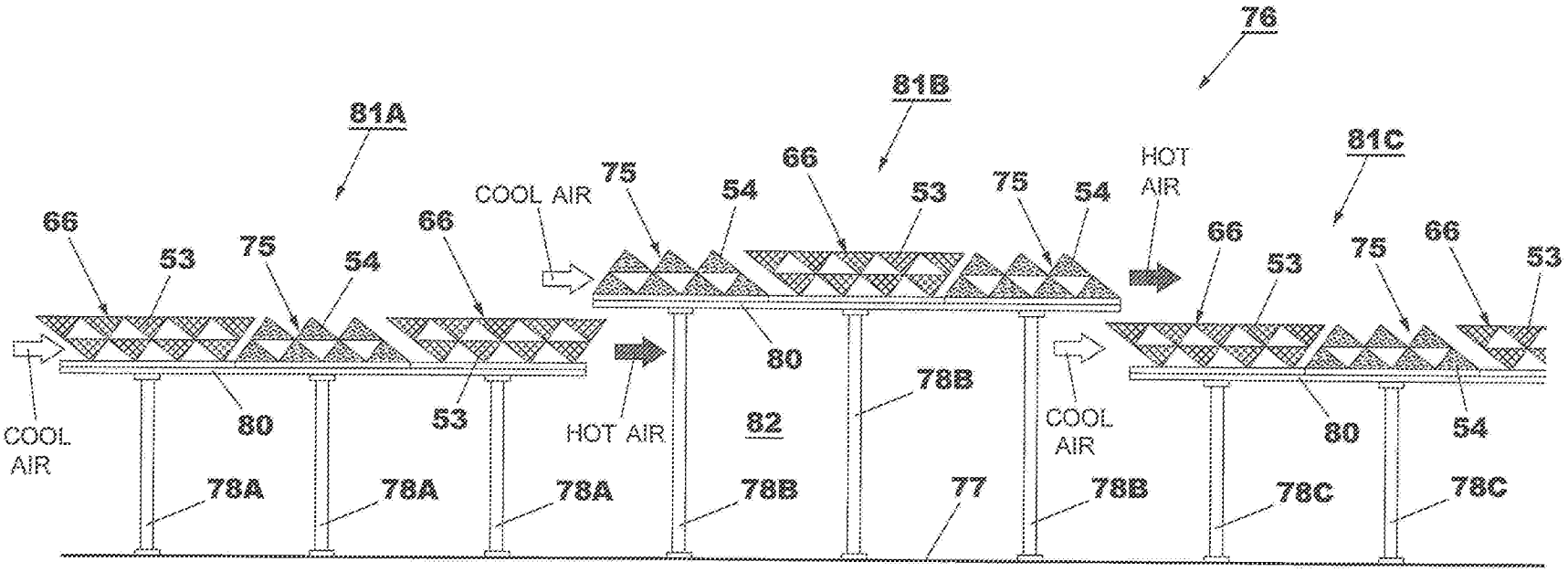
[FIG.14]

[FIG.15]
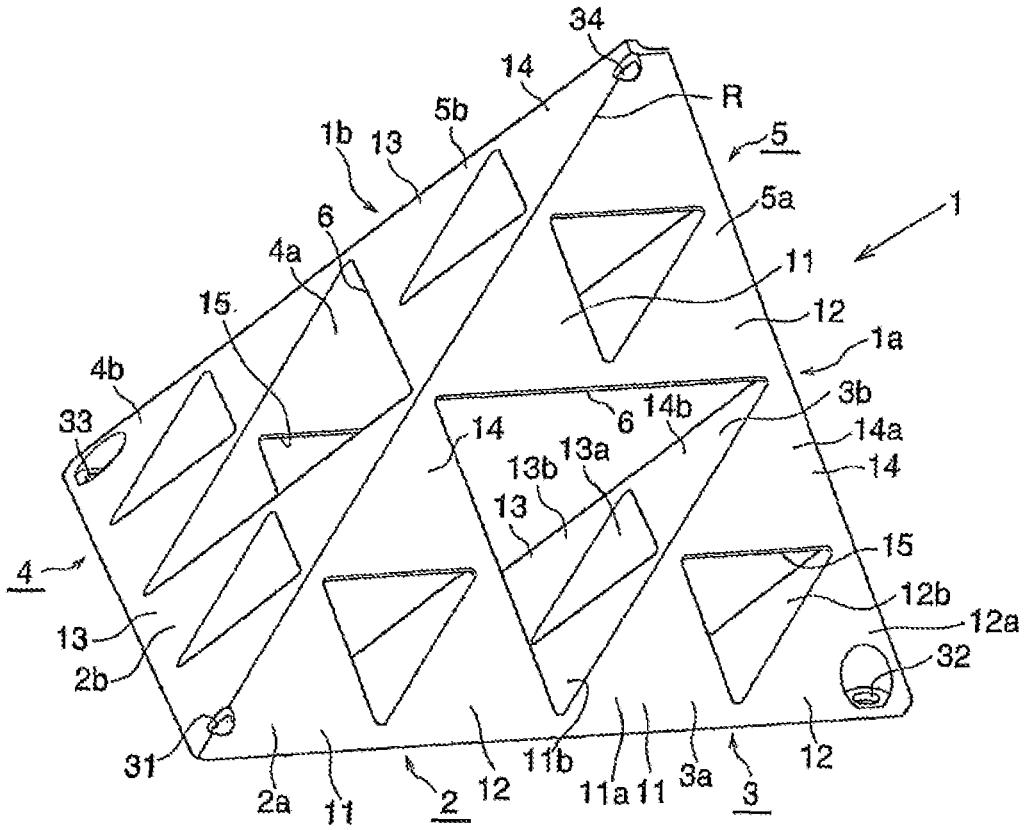

[FIG.16]
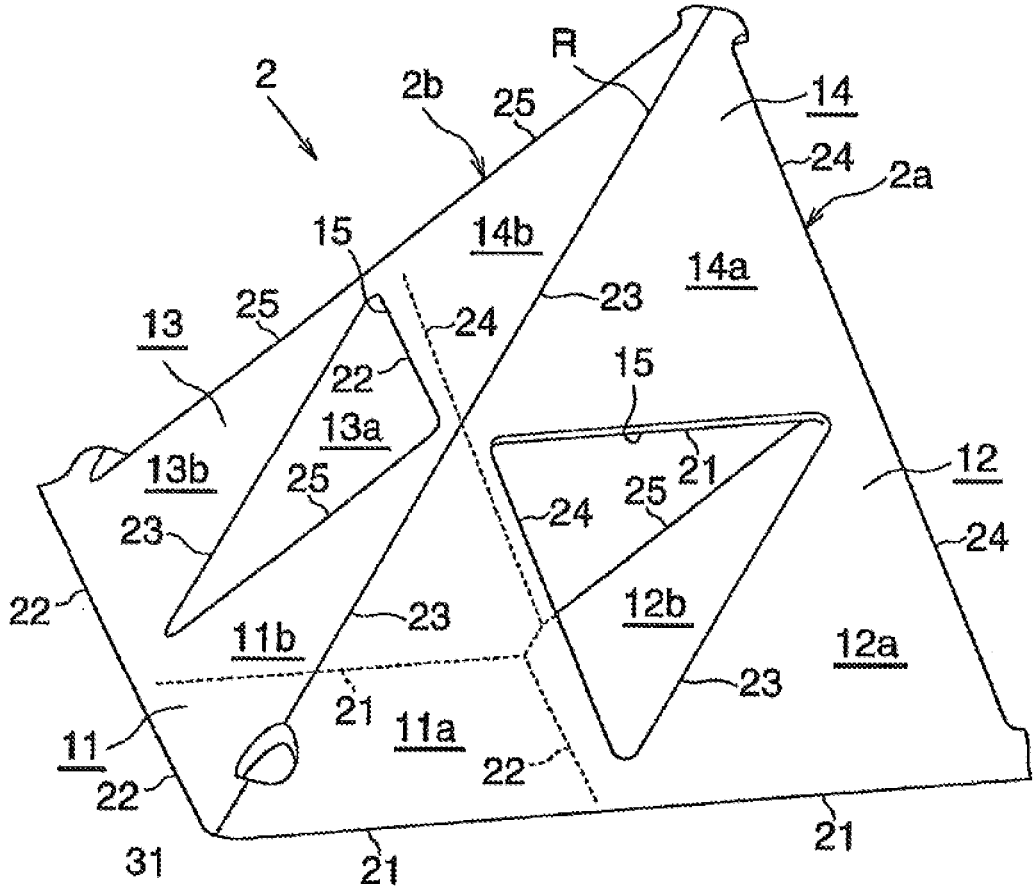

[FIG.17]
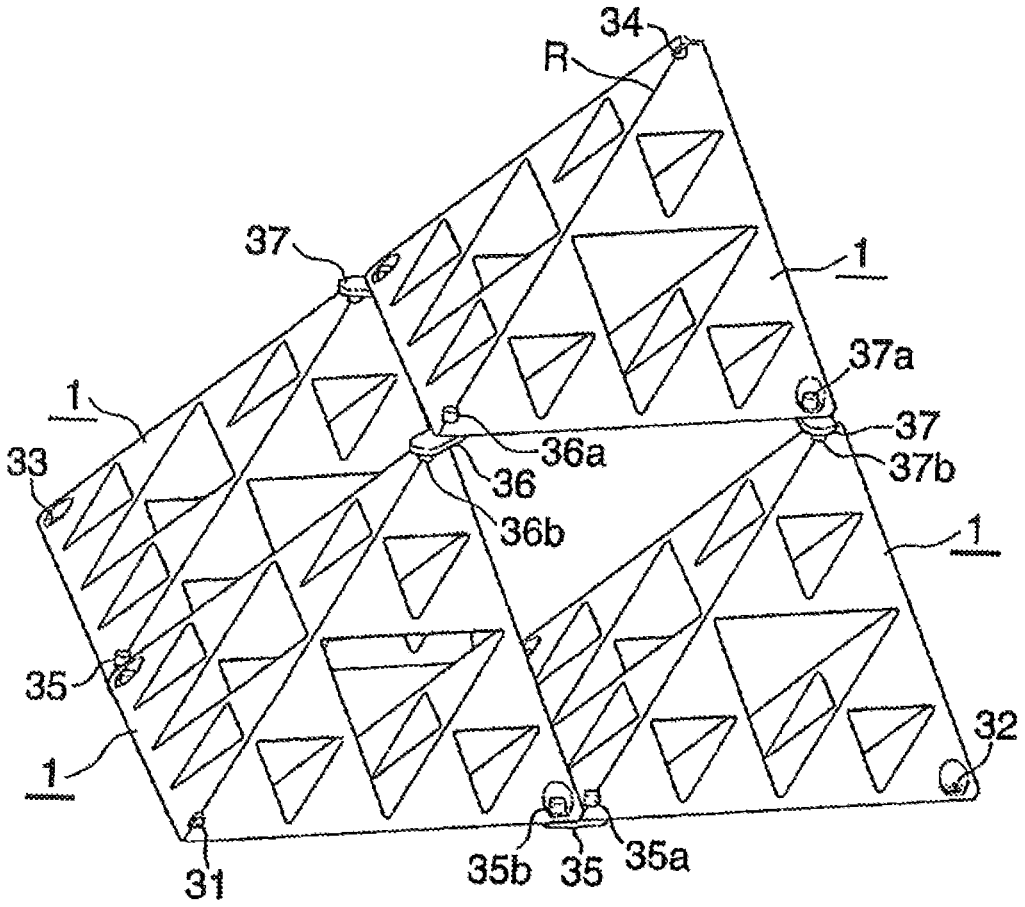

SUNSHADE

FIELD OF THE INVENTION

The invention relates to a sunshade, and particularly to the sunshade including a combination of a plurality of sunshade members having a structure such that a plurality of light-shielding surfaces and through-holes are three-dimensionally arranged therein.

DESCRIPTION OF THE RELATED ART

There has already been proposed a sunshade formed by combining a large number of sunshade members having so-called fractal structure as a solution to overcome the heat-island phenomenon being increasingly serious in urban areas, and also contribution to reduce power consumption.

Patent Literature 1: Japanese Patent No. 5315514

Patent Literature 2: Japanese Patent No. 5763977

Here, "fractal structure" refers to a structure having a plurality of clusters, the clusters forming a hierarchical structure and the shape of the clusters belonging to respective hierarchies resembling each other. Sierpinski tetrahedron is known as one of such self-similar solid figures.

A sunshade member embodying such a fractal structure is in itself very complicated in shape, and therefore will be described in detail below, on the basis of Patent Literature 2.

First, as illustrated in FIG. 15, a sunshade member 1 has a fractal structure including four basic components 2, 3, 4 and 5, each of the basic components 2, 3, 4 and 5 in itself having a fractal structure formed in units of dihedrons 11, 12, 13 and 14 formed by symmetrically integrated triangles of a same shape.

Each of the basic components 2, 3, 4 and 5 are formed by arranging the four dihedrons 11, 12, 13 and 14 laterally, depthwise, and vertically adjacent to each other, which appear quadrangular when seen from a plane, and include the first dihedron 11 located at a reference position, the second dihedron 12 provided to the right of the first dihedron 11, the third dihedron 13 provided behind the first dihedron 11, and the fourth dihedron 14 provided above the first to the third dihedrons 11, 12 and 13.

The sunshade member 1 is formed by arranging the four basic components 2, 3, 4 and 5 laterally, depthwise, and vertically adjacent to each other, and includes the first basic component 2 located at a reference position, the second basic component 3 provided to the right of the first basic component 2, the third basic component 4 provided behind the first basic component 2, and the fourth basic component 5 provided above the first to the third basic components 2, 3 and 4.

As illustrated in FIG. 16 in an enlarged manner, the four dihedrons 11, 12, 13 and 14 forming the basic component 2 (the same goes for the other basic components 3, 4 and 5) have the same shape, each of the dihedrons 11, 12, 13 and 14 includes small-triangular plates 11*a*, 12*a*, 13*a* and 14*a* forming the front face, and small-triangular plates 11*b*, 12*b*, 13*b* and 14*b* forming the side face.

The first dihedron 11 includes lower edges 21 and 22 located on the lateral plane to form the two sides of the square in the lateral direction and the depthwise direction, a common edge 23 extending diagonally upward from the intersection between the lower edges 21 and 22 and forming the ridge R, and upper edges 24 and 25 respectively located nearer and farther in depth and connecting the top end of the common edge 23 and the ends of the lower edges 21 and 22.

The second dihedron 12 includes a lateral lower edge 21 which is a lateral extension of the lateral lower edge 21 of the first dihedron 11, a depthwise lower edge 22 which is parallel to the depthwise lower edge 22 of the first dihedron 11, a common edge 23 which is parallel to the common edge 23 of the first dihedron 11, and nearer and farther upper edges 24 and 25 which are respectively parallel to the nearer and farther upper edges 24 and 25 of the first dihedron 11.

The third dihedron 13 includes a depthwise lower edge 22 which is a depthwise extension of the depthwise lower edge 22 of the first dihedron 11, a lateral lower edge 21 which is parallel to the lateral lower edge 21 of the first dihedron 11, a common edge 23 which is parallel to the common edge 23 of the first dihedron 11, and nearer and farther upper edges 24 and 25 which are respectively parallel to the nearer and farther upper edges 24 and 25 of the first dihedron 11.

The fourth dihedron 14 includes a common edge 23 which is a diagonally upward extension of the common edge 23 of the first dihedron 11, a nearer upper edge 24 which is a diagonally upward extension of the nearer upper edge 24 of the second dihedron 12, a farther upper edge 25 which is a diagonally upward extension of the farther upper edge 25 of the third dihedron 13, a lateral lower edge 21 which is parallel to the lateral lower edge 21 of the first dihedron 11, and a depthwise lower edge 22 which is parallel to the depthwise lower edge 22 of the first dihedron 11.

In FIG. 16, the small-triangular plates 11*a*, 12*a* and 14*a* forming the front faces of the first, the second, and the fourth dihedrons 11, 12 and 14, respectively lie on a same plane (front face), and the small-triangular plate 12*b* forming the side face of the second dihedron 12 is bent toward the bottom face relative to the front face so as to form a small triangular through-hole 15 on the front face of the basic component 2.

In addition, the small-triangular plates 11*b*, 13*b* and 14*b* forming the side faces of the first, the third, and the fourth dihedrons 11, 13 and 14, respectively lie on a same plane (side face), and the small-triangular plate 13*a* forming the front face of the third dihedron 13 is bent toward the bottom face relative to the side face so as to form a small triangular through-hole 15 on the side face of the basic component 2.

As thus described, the basic component 2 has a dihedral shape including a dihedron main body constructed by joining, via the ridge R, two medium triangular plates 2*a* and 2*b* having the small triangular through-hole 15 at the central part thereof, and small-triangular plates (protrusions) 12*b* and 13*a* bent toward the bottom face relative to the medium triangular plates 2*a* and 2*b*.

In the sunshade member 1 including the four basic components 2, 3, 4 and 5, the medium triangular plates 2*a*, 3*a* and 5*a* forming the front face of the first, the second, and the fourth basic components 2, 3 and 5 lie on a same plane (front face), and the medium triangular plate 3*b* forming the side face of the second basic component 3 is bent toward the bottom face relative to the front face so as to form a medium triangular through-hole 6 on a large triangular part 1*a* of the front face In addition, the medium triangular plates 2*b*, 4*b* and 5*b* forming the side face of the first, the third, and the fourth basic components 2, 4 and 5 lie on a same plane (side face), and the medium triangular plate 4*a* forming the front face of the third basic component 4 is bent toward to the bottom face relative to the side face so as to form the a medium triangular through-hole 6 on a large triangular part 1*b* of the side face.

As a result, a sunshade member assembly 1 has a dihedral shape including a dihedron main body constructed by joining, via the ridge R, two large triangular plates 1*a* and 1*b* having the medium-triangular through-hole 6 at the central part thereof, and medium-triangular plates (protrusions) 3*b* and 4*a* bent toward the bottom face relative to the large triangular plates 1*a* and 1*b*.

Therefore, the sunshade block, which is an assembly of the sunshade members 1 illustrated in FIG. 17, is obtained by regarding the sunshade members 1 as basic components, arranging four of the sunshade members 1 laterally, depthwise, and vertically in a manner similar to the basic components 2, 3, 4 and 5, and a sunshade of a required size may be obtained by increasing the number of sunshade blocks to be used, as appropriate.

When forming a sunshade using the sunshade members 1 described above, a sunshade unit is formed by preparing a large number of sunshade blocks having four of the sunshade members 1 coupled together, and preliminarily assembling respective sunshade blocks to a rectangular frame member.

In addition, the sunshade is formed by mounting and securing a plurality of sunshade units on a base frame supported by a plurality of legs (see FIG. 10).

SUMMARY OF THE INVENTION

Problem to be Solved by the Invention

Orienting the ridge R of each of the sunshade members 1 included in the aforementioned sunshade block to the south side causes the sunbeam to be blocked by the sunshade members 1, and therefore allows for exhibiting sunshade effect.

In addition, each of the sunshade members 1 has a large number of triangular through-holes formed thereon, with the light-shielding surfaces being distributed in the 3-dimensional space, which allows for quickly releasing heat into the air via a gap provided between the light-shielding surfaces.

However, although it is possible to prevent rising of the temperature of the sunshade members installed windward in a case where a relatively large-sized sunshade is formed by coupling a large number of sunshade units, the efficiency of releasing heat into the air relatively decreases because air including heat flows into the sunshades installed leeward.

Accordingly, the temperature of sunshade members installed leeward rises higher than that of the sunshade members installed windward, whereby the effect as a sunshade decreases.

For example, when the wind velocity is 3 m/second, the temperature of sunshade members installed 20 m leeward turned out to be about 10° C. higher than the temperature of sunshade members installed windward.

In addition, forming a relatively wide sunshade as described above inevitably results in a plane, monotonous appearance, which has induced the problem of unfashionable design.

It is an object of the invention, which has been made to solve the aforementioned conventional problems, to provide a technique that allows for exhibiting an almost uniform performance without causing partial degradation of performance even when forming a large-scale sunshade with a relatively large area.

In addition, it is also an object of the invention to improve the design of the sunshade as a whole by providing a wide variety of appearance.

Means for Solving the Problem

To achieve the aforementioned object, a sunshade which, according to claim 1, is a sunshade including a plurality of sunshade units having assembled thereto, in alignment in a certain direction, a plurality of sunshade members having a plurality of light-shielding surfaces and a plurality of through-holes three-dimensionally arranged therein, and being structured so that, when observed from a predetermined maximum light-shielding angle, the transmitted light beams are seen to be substantially shielded by respective light-shielding surfaces provided therebehind, with some of the sunshade units being provided at higher positions than other sunshade units in the vertical direction.

The sunshade according to claim 2 is the sunshade of claim 1, with the aforementioned sunshade units being further divided into a plurality of groups, each sunshade unit being supported by separate legs for each group at a position separated from the installation surface by a predetermined distance, the height of some of the legs supporting respective groups being different from the height of legs supporting other groups.

Effects of the Invention

Although it is generally preferred that the sunshade units have an area of 3 to 10 $m^2$ so as to make the assembly work easier, adjacently arranging a plurality of sunshade units to expand the area of the sunshade may result in degradation of performance of leeward sunshade members because they are affected by heat removed by windward sunshade members as described above.

Broadly speaking, a distance equal to or wider than 5 m between sunshade members included in a sunshade unit causes the performance to gradually degrade toward the leeward side.

The invention allows for solving such a conventional problem.

In other words, even when combining a plurality of sunshade units to forma large-scale sunshade with a large area, a height difference is intentionally provided between the sunshade units so as to prevent the air warmed bypassing through windward sunshade units from directly flowing into adjacent sunshade units. Accordingly, it becomes possible to let fresh cool air flow into leeward sunshade units, which allows for exhibiting an almost uniform performance with little partial performance degradation.

In addition, it is possible to provide a sunshade with a wide variety of appearance, which also leads to an improved design.

BEST MODE FOR CARRYING OUT THE INVENTION

FIG. 1 is perspective view illustrating a sunshade member 50 according to the invention, the basic structure of which being substantially identical to that of the conventional sunshade member 1 described in FIG. 15, and therefore corresponding parts are provided with identical reference numerals so as to omit duplicate explanation.

In the case of the sunshade member 50, however, there are provided, in a protruding manner at the four corners thereof, a first connection piece 51*a*, a second connection piece 51*b*, a third connection piece 51*c*, and a fourth connection piece 51*d*, which are connected to another sunshade member 50 or a frame member described below, via a through-hole 52 of each connection piece.

In addition, small-triangular plates 11*a*, 12*a*, 13*a* and 14*a* and small-triangular plates 11*b*, 12*b*, 13*b* and 14*b* correspond to a plurality of "light-shielding surfaces", and a small triangular through-hole 15 and a medium triangular through-hole 6 correspond to a plurality of "through-holes".

FIG. 2 is a schematic view illustrating sunshade blocks being formed using four of the sunshade members 50, and sunshade blocks 53 and 54 being formed by engaging connection pieces of the first sunshade member 50*a*, the second sunshade member 50*b*, the third sunshade member 50*c*, and the fourth sunshade member 50*d* via screws and nuts which are not illustrated.

Specifically, the following connection pieces are engaged together.

(1) the second connection piece 51*b* of the first sunshade member 50*a* and the first connection piece 51*a* of the second sunshade member 50*b*

(2) the third connection piece 51*c* of the first sunshade member 50*a* and the first connection piece 51*a* of the third sunshade member 50*c*

(3) the fourth connection piece 51*d* of the first sunshade member 50*a* and the first connection piece 51*a* of the fourth sunshade member 50*d*

(4) the third connection piece 51*c* of the second sunshade member 50*b* and the second connection piece 51*b* of the third sunshade member 50*c*

(5) the fourth connection piece 51*d* of the second sunshade member 50*b* and the second connection piece 51*b* of the fourth sunshade member 50*d*

(6) the fourth connection piece 51*d* of the third sunshade member 50*c* and the third connection piece 51*c* of the fourth sunshade member 50*d*

Each of the sunshade blocks 53 and 54 formed in the aforementioned manner includes therein a large number of similar figures, which in themselves include fractal structures (see FIG. 17).

In addition, the first connection piece 51*a* of the first sunshade member 50*a*, the second connection piece 51*b* of the second sunshade member 50*b*, the third connection piece 51*c* of the third sunshade member 50*c*, and the fourth connection piece 51*d* of the fourth sunshade member 50*d* respectively constitute the first connection piece 55*a*, the second connection piece 55*b*, the third connection piece 55*c*, and the fourth connection piece 55*d* of the blocks 53 and 54.

In the invention, there is a case of using the sunshade block in a manner similar to that illustrated in FIG. 17, and a case of using it in a reversed manner, and therefore the both are distinguished by referring to the former as a normal block 53 and the latter as an inverted block 54.

In addition, the normal block 53 and the inverted block 54 illustrated in FIG. 2 or later, are described with all the triangular through-holes being omitted therefrom for convenience of illustration.

A sunshade unit is formed by assembling a plurality of the normal blocks 53 and the inverted blocks 54 on a frame member of a predetermined size which has been preliminarily standardized.

FIG. 3 illustrates the first frame member 60, which has four leaf sash bars 63 provided and secured in a manner spaced apart in parallel from each other by a predetermined interval within a quadrangular frame formed by a pair of vertical sash bars 61 and a pair of lateral sash bars 62.

After having mounted two normal blocks 53 on each of the leaf sash bars 63 of the first frame member 60, a screw 64 is inserted through the through-hole 52 of each of the second connection piece 55*b* and the fourth connection piece 55*d*, and screwed with the lateral sash bar 62 or the leaf sash bar 63. On this occasion, a common screw 64 is inserted through the fourth connection piece 55*d* of one of the normal block 53 and the second connection piece 55*b* of the other normal block 53, and screwed with the leaf sash bar 63.

As a result of the foregoing, a total of eight of the normal blocks 53 forming the first tier are secured to the first frame member 60, as illustrated in FIG. 4.

Next, the normal blocks 53 forming the second tier are mounted on an adjacent pair of the normal blocks 53. On this occasion, the second connection piece 55*b* and the fourth connection piece 55*d* of the normal block 53 located thereabove are secured in a manner conforming to the first connection piece 55*a* of each of the normal blocks 53 located thereunder, inserting the screw 64 through each of the through-holes 52 and securing it with a nut (not illustrated).

Repeating the work results in completion of a normal unit 66 having a total of 13 of the normal blocks 53 mounted thereon (eight on the first tier, and five on the second tier) as illustrated in FIG. 5.

As can be seen in the drawing, with regard to each of the normal blocks 53 forming the second tier, the third connection piece 55*c* of the anterior normal block 53 and the first connection piece 55*a* of the posterior normal block 53 are mutually joined via the screw 64 and the nut.

FIG. 6 illustrates the second frame member 68, which has two of the leaf sash bars 63 provided and secured in a manner spaced apart in parallel from each other by a predetermined interval within a quadrangular frame formed by a pair of the vertical sash bars 61 and a pair of the lateral sash bars 62.

By having mounted the inverted blocks 54 on each of the leaf sash bars 63 of the second frame member 68, inserting the screw 64 through the through-hole 52 of each of the first connection piece 55*a* and the third connection piece 55*c*, and screwing it with the leaf sash bar 63 or the vertical sash bar 61, the inverted blocs 54 are secured on each of the leaf sash bars 63 of the second frame member 68.

As illustrated in FIG. 7, four of the inverted blocks 54 are secured along each of the leaf sash bars 63, the first tier is formed by a total of eight of the inverted blocks 54.

In the aforementioned case, rod-shaped reinforcing members 69 are mounted respectively on the inverted block 54 mounted on one of the leaf sash bars 63 and the inverted block 54 mounted on the other leaf sash bar 63.

A total of four of the reinforcing members 69 respectively have three screw holes 70 formed thereon, among which the first screw hole 70 is formed at a position conforming to the through-hole 52 of the fourth connection piece 55*d* of the inverted block 54 provided on one of the leaf sash bars 63. In addition, the second screw hole 70 is formed at a position conforming to the through-hole 52 of the second connection piece 55*b* of the inverted block 54 provided on one of the leaf sash bars 63 and the through-hole 52 of the fourth connection piece 55*d* of the inverted block 54 provided on the other leaf sash bar 63. Furthermore, the third screw hole 70 is formed at a position conforming to the through-hole 52 of the second connection piece 55*b* of the inverted block 54 provided on the other leaf sash bar 63.

Next, as illustrated in FIG. 8, three of the inverted blocks 54 are arranged in a vertically aligned column between the reinforcing members 69, and the through-holes 52 of the first connection piece 55*a* and the third connection piece 55*c* are positioned with the screw holes 70 of each of the reinforcing members 69.

Subsequently, the screw 64 is inserted through each of the screw holes 70 and the through-holes 52 from the backside of the reinforcing member 69, and screw-clamped by the nut 71.

As a result, a total of nine inverted blocks 54 are provided and secured between the reinforcing members 69, the inverted blocks 54 thus forming the second tier, as illustrated in FIG. 9.

Each of the three inverted blocks 54 arranged in a vertically aligned column forming the second tier has mounted thereon a relatively long rod-shaped reinforcing member 72.

Each of a total of three of the reinforcing members 72 has formed thereon four screw holes 70, which are positioned with the through-holes 52 of the connection piece of each of the inverted blocks 54.

Subsequently, the screw 64 is inserted through each of the through-holes 52 and the screw holes 70 from the backside of inverted blocks 54, and screw-clamped by the nut 71.

As a result, an inversely-placed unit 75 having mounted thereon a total of 17 of the inverted blocks 54 (eight on the first tier, and nine on the second tier) is completed.

The normal units 66 and the inverted units 75 are preliminarily produced in a factory as many as needed, and subsequently transported by truck to the installation site where they are assembled into a sunshade.

FIG. 10, in which a completed sunshade 76 is exemplified, illustrates abase frame 80 being mounted on a plurality of legs 78 set up perpendicular to an installation surface 77, and the normal units 66 and the inverted unit 75*s* being secured thereon.

The normal units 66 and the inverted units 75 are lifted above the base frame 80 by a forklift or a truck mounted crane, and secured by a connector which is not illustrated.

FIG. 11, which is a plan view of the sunshade 76, illustrates the normal units 66 and the inverted units 75 being alternately arranged in depthwise and lateral directions.

When arranging the normal units 66 and the inverted units 75, it is desirable to perform positioning so that the ridges of the normal blocks 53 included in the normal units 66 orthogonally cross with the south side, and the ridges of the inverted blocks 54 included in the inverted units 75 are parallel to the south side.

As thus described, arranging the normal units 66 including a plurality of the normal blocks 53 and the inverted units 75 including a plurality of the inverted blocks 54 in a so-called checked pattern results in engagement of a block protruding from one unit with an empty space in the other unit, thereby making it possible to efficiently form a light-shielding surface with narrowed gaps.

The invention, however, is not limited to the aforementioned embodiments, and does not exclude formation of a sunshade using a large number of sunshade units of either the normal units 66 or the inverted units 75.

In addition, when forming a sunshade using such sunshade units, although there is a possibility that a gap may occur at some places of the light-shielding surface, it suffices to fill individual gaps by assembling additional sunshade blocks.

In addition, the configuration of each sunshade unit is not limited to the foregoing and a wide range of variation is conceivable with regard to the number of, or the interval between the leaf sash bars 63, the number of, or the manner of installing the sunshade blocks to be installed or the number of tiers.

As has been described above, orienting the ridge R of each of the sunshade members 50 included in each sunshade block to the south side causes the sunbeam to be blocked by the sunshade members 50, and therefore allows for exhibiting sunshade effect.

In addition, each of the sunshade members 50 has a large number of triangular through-holes formed thereon, with the light-shielding surfaces being distributed in the 3-dimensional space, which allows for quickly releasing heat into the air via a gap provided between the light-shielding surfaces.

However, in a case of adjacently arranging a plurality of sunshade groups 81A and 81B respectively including a plurality of sunshade units to form the relatively wide-spread sunshade 76, as illustrated in FIG. 12, there arises a problem of decreased heat dissipation effect because the wind (hot air) whose temperature has risen due to heat released from the sunshade members 50 of a sunshade group located windward turns out to flow into the sunshade members 50 of the sunshade group located leeward.

When, for example, the wind velocity is 3 m/second, the temperature of the sunshade members 50 installed 20 m leeward has risen higher than the temperature of the sunshade members 50 installed windward by about 10° C.

Accordingly, there has occurred an unevenness of the degree of coolness under the shade 82 depending on the position thereof.

Therefore, when adjacently arranging a plurality of sunshade groups to form the relatively wide-spread sunshade 76, it is effective for assuring heat dissipation effect to cause the vertical position (distance from the installation surface 77) of the sunshade members 50 included in each sunshade group to be different, as illustrated in FIG. 13.

In the drawing, the height of the legs 78 supporting three sunshade groups 81A, 81B and 81C is set to be higher in the order from the windward to the leeward.

Specifically, the height of legs 78A of the first sunshade group 81A arranged most windward is set to 2.5 m, the height of legs 78B of the second sunshade group 81B arranged at the middle is set to 3.0 m, and the height of legs 78C of the third sunshade group 81C arranged most leeward is set to 3.5 m.

As a result, air heated to a high temperature (hot air) bypassing through the sunshade members 50 of the first sunshade group 81A is released toward the legs 78B without flowing into the sunshade members 50 of the second sunshade group 81B.

In addition, it turns out that cool air which has passed over the first sunshade group 81A flows into the sunshade members 50 of the second sunshade group 81B.

Similarly, air heated to a high temperature (hot air) by passing through the sunshade members 50 of the second sunshade group 81B is released toward the legs 78C without flowing into the sunshade members 50 of the third sunshade group 81C.

In addition, it turns out that cool air which has passed over the second sunshade group 81B flows into the sunshade members 50 of the third sunshade group 81C.

As has been described above, cool air from the windward always flows into the sunshade members 50 of each sunshade group, and therefore heat dissipation effect in each group is not obstructed by inflow of hot air.

As a result, it is possible to resolve temperature unevenness in the shade 82 and provide uniform coolness.

Note that, in a case where a gap occurs by setting a stage difference among the sunshade groups, it suffices to add a sunshade block for filing the gap.

FIG. 13 illustrates an example in which the normal block 53 is provided in the gap between the second sunshade group 81B and the third sunshade group 81C.

In the aforementioned case, although an example is presented in which the height of each sunshade group gradually increases from the windward toward the leeward, there may also be a contrary configuration such that the height of each sunshade group gradually decreases from the windward toward the leeward.

In addition, there may also be a configuration that sets the height of each sunshade group to be alternately higher or lower than the next from the windward toward the leeward.

FIG. 14 illustrates an example thereof, in which the height of legs 78A of the first sunshade group 81A arranged most windward and the height of legs 78C of the third sunshade group 81C arranged most leeward are equally set to 2.5 m, whereas the height of legs of the second sunshade group 81B arranged at the middle is set to 3.0 m, which is the highest.

In the aforementioned case, air heated to a high temperature (hot air) by passing through the sunshade members 50 of the first sunshade group 81A is released toward the legs 78B without flowing into the sunshade members 50 of the second sunshade group 81B.

In addition, it turns out that cool air which has passed over the first sunshade group 81A flows into the sunshade members 50 of the second sunshade group 81B.

Similarly, air heated to a high temperature (hot air) by passing through the sunshade members 50 of the second sunshade group 81B turns out to be released upward without flowing into the sunshade members 50 of the third sunshade group 81C.

In addition, air which has been cooled while passing between the legs 78B of the second sunshade group 81B flows into the sunshade members 50 of the third sunshade group 81C, and therefore it becomes possible to effectively release heat of each of the sunshade members 50.

BRIEF DESCRIPTION OF DRAWINGS

FIG. 1 is a perspective view illustrating an example of a sunshade member according to the invention;

FIG. 2 is a schematic view illustrating formation of a block using four sunshade members;

FIG. 3 is a perspective view illustrating assembly of two tiers of normal blocks to the first frame member;

FIG. 4 is a perspective view illustrating assembly of two tiers of normal blocks to the first frame member;

FIG. 5 is a perspective view illustrating assembly of two tiers of normal blocks to the first frame member;

FIG. 6 is a perspective view illustrating assembly of two tiers of inverted blocks to the second frame member;

FIG. 7 is a perspective view illustrating assembly of two tiers of inverted blocks to the second frame member;

FIG. 8 is a perspective view illustrating assembly of two tiers of inverted blocks to the second frame member;

FIG. 9 is a perspective view illustrating assembly of two tiers of inverted blocks to the second frame member;

FIG. 10 is a side elevation view illustrating a sunshade formed using normal units and inverted units;

FIG. 11 is a plan view illustrating a sunshade formed using normal units and inverted units;

FIG. 12 is a side elevation view for explaining an adverse effect when a large-scale sunshade is formed;

FIG. 13 is a side elevation illustrating a configuration for avoiding the adverse effect when a large-scale sunshade is formed;

FIG. 14 is a side elevation illustrating another configuration for avoiding the adverse effect when a large-scale sunshade is formed;

FIG. 15 is a perspective view illustrating a conventional sunshade member;

FIG. 16 is an enlarged perspective view of basic components of the conventional sunshade member; and FIG. 17 is a perspective view illustrating a sunshade block assembled using four conventional sunshade members.

EXPLANATION OF REFERENCES

11*a* to 14*d* small-triangular plate
11*b* to 14*b* small-triangular plate
6 medium-triangular through-hole
15 small triangular through-hole
50 sunshade member
51*a* first connection piece of sunshade member
51*b* second connection piece of sunshade member
51*c* third connection piece of sunshade member
51*d* fourth connection piece of sunshade member
52 through-hole
53 normal block
54 inverted block
55*a* first connection piece of block
55*b* second connection piece of block
55*c* third connection piece of block
55*d* fourth connection piece of block
60 first frame member
61 vertical sash bar
62 lateral sash bar
63 leaf sash bar
64 screw
66 normal unit
68 second frame member
69 reinforcing member
70 screw hole
71 nut
72 reinforcing member
75 inverted unit
76 sunshade
77 installation surface
78 leg
80 base frame
81 sunshade group
82 shade

The invention claimed is:

1. A sunshade, comprising:

a plurality of sunshade units each having, in alignment in a certain direction, a plurality of sunshade members arranged in a plurality of tiers and having a plurality of light-shielding surfaces and a plurality of through-holes three-dimensionally arranged therein, and being structured so that, when observed from a predetermined maximum light-shielding angle, the transmitted light beams are seen to be substantially shielded by respective light-shielding surfaces of the plurality of light-shielding surfaces provided therebehind, wherein some of the sunshade units are provided at higher positions than other sunshade units of the sunshade units in the vertical direction such that air passing through the plurality of sunshade members arranged in a plurality of tiers of one of said some of the sunshade units is released above or below an adjacent sunshade unit of the other sunshade units without flowing into the plurality of sunshade members of the adjacent sunshade unit and such that cool air which passes the one of said some of the sunshade units flows into the plurality of sunshade members of the adjacent sunshade unit.

2. The sunshade according to claim 1, wherein the sunshade units are divided into a plurality of groups, each sunshade unit is supported by separate legs for each group at a position separated from the installation surface by a predetermined distance, and a height of the legs supporting a first of said plurality of groups being different from a height of the legs supporting another group of said plurality of groups.

* * * * *